United States Patent [19]

Mattox et al.

[11] Patent Number: 4,699,376

[45] Date of Patent: Oct. 13, 1987

[54] HIP AND KNEE JOINT EXERCISING APPARATUS

[75] Inventors: Ernest M. Mattox, Belmont; Andrew J. Van Noord, Grand Rapids, both of Mich.

[73] Assignee: Portable Isokinetics, Inc., Grand Rapids, Mich.

[21] Appl. No.: 810,657

[22] Filed: Dec. 18, 1985

Related U.S. Application Data

[63] Continuation-in-part of Ser. No. 599,513, Apr. 12, 1984, abandoned, and a continuation-in-part of Ser. No. 603,502, Apr. 24, 1984, abandoned.

[51] Int. Cl.[4] ..... A63B 21/00

[52] U.S. Cl. ..... 272/131; 272/134

[58] Field of Search ..... 272/93, 116–117, 272/130, 131, 125, 134, 142, 143; 128/25 R

[56] References Cited

U.S. PATENT DOCUMENTS

| | | | |
|---|---|---|---|
| 2,621,043 | 12/1952 | Olmstead | 272/131 |
| 2,680,967 | 6/1954 | Newman . | |
| 2,708,367 | 5/1955 | Lusk . | |
| 2,832,334 | 4/1958 | Whitelaw | 272/132 X |
| 3,000,632 | 9/1961 | Fuchs | 272/134 X |
| 3,089,700 | 5/1963 | Hotas | 272/117 |
| 3,174,343 | 3/1965 | Kasolis | 272/130 X |
| 3,190,648 | 6/1965 | Kallenbach | 272/125 |
| 3,298,688 | 1/1967 | Grzybowski | 272/131 |
| 3,466,931 | 9/1969 | Spackman, Jr. et al. . | |
| 3,589,720 | 6/1971 | Agamian . | |
| 3,768,808 | 10/1973 | Passera | 272/142 X |
| 3,971,255 | 7/1976 | Varney et al. | 272/131 X |
| 4,208,049 | 6/1980 | Wilson . | |
| 4,249,725 | 2/1981 | Mattox | 272/130 X |
| 4,384,715 | 5/1983 | Savio et al. | 272/136 |
| 4,407,496 | 10/1983 | Johnson | 272/143 X |
| 4,487,199 | 12/1984 | Saringer | 128/25 R |

FOREIGN PATENT DOCUMENTS

| | | | |
|---|---|---|---|
| 912388 | 10/1972 | Canada | 128/25 R |
| 966523 | 4/1975 | Canada | 272/131 |
| 604340 | 5/1960 | Italy | 272/142 |
| 2031285 | 4/1980 | United Kingdom . | |

*Primary Examiner*—Richard J. Apley
*Assistant Examiner*—Robert W. Bahr
*Attorney, Agent, or Firm*—Varnum, Riddering, Schmidt & Howlett

[57] ABSTRACT

Hip and knee joint exercising apparatus (100,, 300) are adapted for use by a patient (218) to exercise selective muscle/skeletal groups in the hip, upper leg, knee and lower leg regions. The exercise apparatus (100, 300) include rectangular bases (102, 302) having cushions (104, 304) mounted thereon, In the hip joint exercising apparatus (100), an exercise bar assembly (112) is pivotably coupled to the base (102) and cushion (104) and includes an elongated outer tube (126) with a power slide (134) having a friction mounting on the tube (126). In the knee joint exercising apparatus (300), an exercise bar assembly (326) is pivotably coupled to a pair of tubular bars (308) extending downwardly from the base (302). In each exercising apparatus, a saddle assembly (138, 338) is mounted to the respective power slide (134, 334) so as to be slidable therewith with respect to the outer tube (126, 328). Force measuring mechanisms (128, 362) are coupled to the tubes (126, 328) so as to measure external forces exerted by the patient (218) in moving the tubes (126, 328) relative to handle rods (126, 328) partially received within the tubes (126, 128).

17 Claims, 14 Drawing Figures

HIP AND KNEE JOINT EXERCISING APPARATUS

RELATED APPLICATIONS

This application is a continuation-in-part of copending U.S. patent application Ser. No. 599,513 filed Jul. 12, 1984 now abandoned also a continuation-in-part of copending U.S. patent application Ser. No. 603,502 filed Jul. 24, 1984 now abandoned.

TECHNICAL FIELD

The invention relates to exercise apparatus and, more particularly, to portable apparatus for exercising selected muscle/skeletal groups in the hips, upper leg regions, knee and lower leg regions, and for measuring the relative magnitudes of forces exerted during exercise.

BACKGROUND ART

Various types of exercise equipment have been developed throughout history. This equipment is often directed to the exercising and strengthening of particular muscle groups, such as the commonly known handheld squeezing devices for exercising muscles of the hands and lower arm. However, more complex devices have been designed for use in strengthening and exercising other selected muscle groups. Historically, many of these devices used weights, springs or other preset resistances to movement. Such devices required the user to use only that amount of strength necessary to move the device through a weakest part of any movement.

Recently, other devices have been developed which offer resistance at a level adapting automatically to the user's abilities and providing resistance at a level the same or nearly the same as the force applied throughout the entire range of an exercise stroke. Such equipment is typically referred to as "isokinetic" exercising equipment. Many isokinetic exercise devices are relatively complex, expensive and require frequent maintenance. In addition, many of these devices are relatively large and typically require positioning at a stationary fixed location.

Example of iscokinetic exercising equipment are disclosed in the U.S. Pat. No. 4,249,725 to Mattox, issued Feb. 10, 1981, and 4,385,760 issued May 31, 1983. More recently, a new isokinetic exercise device has the form of a cane which is relatively portable and capable of movement from location to location. This device is particularly advantageous for handicapped individuals.

Although the cane provides substantial advantages over other known exercising equipment, it is not particularly suited to exercises associated with muscles in the hip, knee and lower leg regions. For example, exercises available for muscle/skeletal groups in the hip regions are limited when the exercising apparatus does not provide any arrangement for supporting or securing different parts of the legs during exercise.

One type of known exercise apparatus specifically directed to exercises for the muscle/skeletal groups in the hip regions and incorporating a leg supporting device includes a base support and an exercise bar pivotably coupled to the base support. A slide is friction-mounted to the bar, and includes a saddle assembly for securing the patient's leg during exercise. Another type of known exercise apparatus directed to exercises for the muscle/skeletal groups in the knee joint regions include a base support and an exercise bar pivotably coupled to a pair of tubular bars extending downwardly from the base support.

It is also advantageous to provide devices to measure the relative amount of force exerted by the user during exercise. One type of exercise device employing a mechanism for measuring forces exerted by a user is described in the U.S. Pat. No. 3,971,255 to Varney, et al. issued Jul. 27, 1976. Varney discloses an exercise bar having a sleeve mounted to an elongated tube and slideable with respect to the tube. Bushings within the tube provide a friction slide between the sleeve and tube, and handles are provided on the sleeve and at one end of the tube. Resistance of the sleeve on the tube is provided through a flat-headed pin and adjustably tensioned spring which exerts forces on the pin. A force measuring device is provided by a coil spring which is positioned between the outer end of the sleeve and an internal bushing. A gauge is mounted on a sleeve and indicates the amount of force applied by the user.

SUMMARY OF THE INVENTION

In accordance with one aspect of the invention, a hip joint exercise apparatus includes a portable structural frame to provide a fixed base support while the apparatus is in use. The frame includes body positioning means to position one portion of the user's body during exercise. The apparatus also includes an elongated tube with first and second ends, and means to pivotably mount the first end of the tube to the frame. A slide member is slidably mounted to the elongated tube, and means provide frictional resistance to movement of the slide member along the tube. In addition, body engaging means are mounted to the slide member for positioning one of the user's legs and for restraining movement of the leg with respect to the slide member during axial movement of the slide member on the tube. Force measuring means are mounted to the tube to visually indicate to the user the relative magnitude of force applied between the slide member and the tube. The elongated tube is pivotable relative to the structural frame simultaneously with the slide member sliding along the tube so as to provide hip flexion/extension, hip abduction and straight leg exercises having resistance forces to both upward and downward movement. The frame and body positioning means provide a reactive relationship to the axial movement of the slide member on the tube.

In one form of the invention, the body positioning means is a cushion on which the user may sit or lie in a prone position. The body engaging means includes a saddle mounted to the slide member and means mounted to the saddle are provided to releasably retain the user's leg in the saddle.

The elongated tube is mounted to the frame so that the user, while lying in a prone position on his or her back on the cushion, can secure a thigh of one of his or her legs in the saddle. The slide member is then moved along the tube by the user moving his or her knee toward and away from his or her chest area.

The tube is also mounted to the frame so that the user, while maintaining a sitting position on the cushion with one of his or her legs positioned transversely across the cushion relative to the tube, and with the leg retained in the saddle at a knee joint, can move the slide member by moving his or her leg laterally in a sideways motion. In addition, the tube is mounted to the frame so that the user, while maintaining a prone position on his or her back on the cushion, can releasably retain one of his or her legs in the saddle at the calf region with the leg fully extended. The slide member can then be moved along the tube by the user alternately raising and lowering his or her leg.

The hip joint exercise apparatus also includes means to adjustably limit the movement of the slide member on the tube. The movement limiting means includes a pair of rings, each slidably mounted on the tube. One of each of the rings is positioned on each side of the slide member, and means are provided on each ring for securing the ring in an adjusted position on the tube. The slide member can thereby be limited to movement along the entire length of the tube down to no movement at selected positions along the tube length.

In addition, the exercise apparatus also includes means received on the tube to prohibit movement of the slide member for strength testing in any position within the range of motion of a user body member. Further, means are received on the tube to prohibit movement of the slide member isometric exercise at any position within the range of motion of the user body member.

In accordance with another aspect of the invention, a knee joint exercise apparatus includes a portable structural frame to provide a fixed base support while apparatus is in use. The frame includes body-positioning means to position one portion of the user's body during exercise. The apparatus also includes an elongated tube with first and second ends, and elongated means also having first and second ends, with the first end of the elongated means connected to the structural frame and positioned to offset the elongated tube from the structural frame. Means are provided to pivotably mount the first end of the tube to the second end of the elongated means. A slide member is slidably mounted to the elongated tube, and means provide frictional resistance to movement of the slide member along the tube. In addition, body-engaging means are mounted to the slide member and adapted to receive one of the user's legs so as to restrain movement of the leg with respect to the slide member during axial movement of the slide member on the tube. Force measuring means are mounted to the tube to visually indicate to the user the relative magnitude of force applied between the slide member and the tube. The frame and body-positioning means provide a reactive relationship to the axial movement of the slide member on the tube.

In one form of the invention, the body-positioning means is a cushion on which the user may sit. The body-engaging means includes a saddle mounted to the slide member, with means mounted to the saddle to releasably retain the user's leg in the saddle. The elongated means includes a pair of tubular bars having one end connected to the structural frame and extending downwardly therefrom. A second end of the tubular bars is pivotably mounted to the elongated tube.

The elongated tube is mounted to the elongated means so that the user, while sitting on the cushion with his or her knees bent at approximately a 90° angle, can secure one of his cr her legs at the ankle region in the saddle. The slide member is then moved along the tube by the user longitudinally rotating his or her ankle relative to the tube. In one form of the invention, the force measuring means is positioned on the second end of the elongated tube.

BRIEF DESCRIPTION OF THE DRAWINGS

The invention will now be described with reference to the drawings in which.

DETAILED DESCRIPTION

The principles of the invention are disclosed, by way of example, in a hip joint exercise apparatus 100 as depicted in FIGS. 1-5 and in a knee joint exercise apparatus 300 as depicted in FIGS. 9-13. The exercise apparatus 100, 300 are adapted for use by individuals as stand-alone units to exercise various muscles in the hip, upper leg, knee and lower leg regions. The apparatus 100, 300 are relatively simple in design, lightweight and portable, thereby particularly advantageous for use by handicapped individuals or other patients undergoing rehabilitative exercise therapy. The apparatus 100, 300 are particularly suited for exercise of muscle/skeletal groups where substantial rehabilitative exercise therapy is often required after injury. As will be described in detail herein, the apparatus 100, 300 are adapted to provide resistance to movement during an exercise stroke, thereby requiring strengthening forces to be exerted by the patient.

Figure 1:
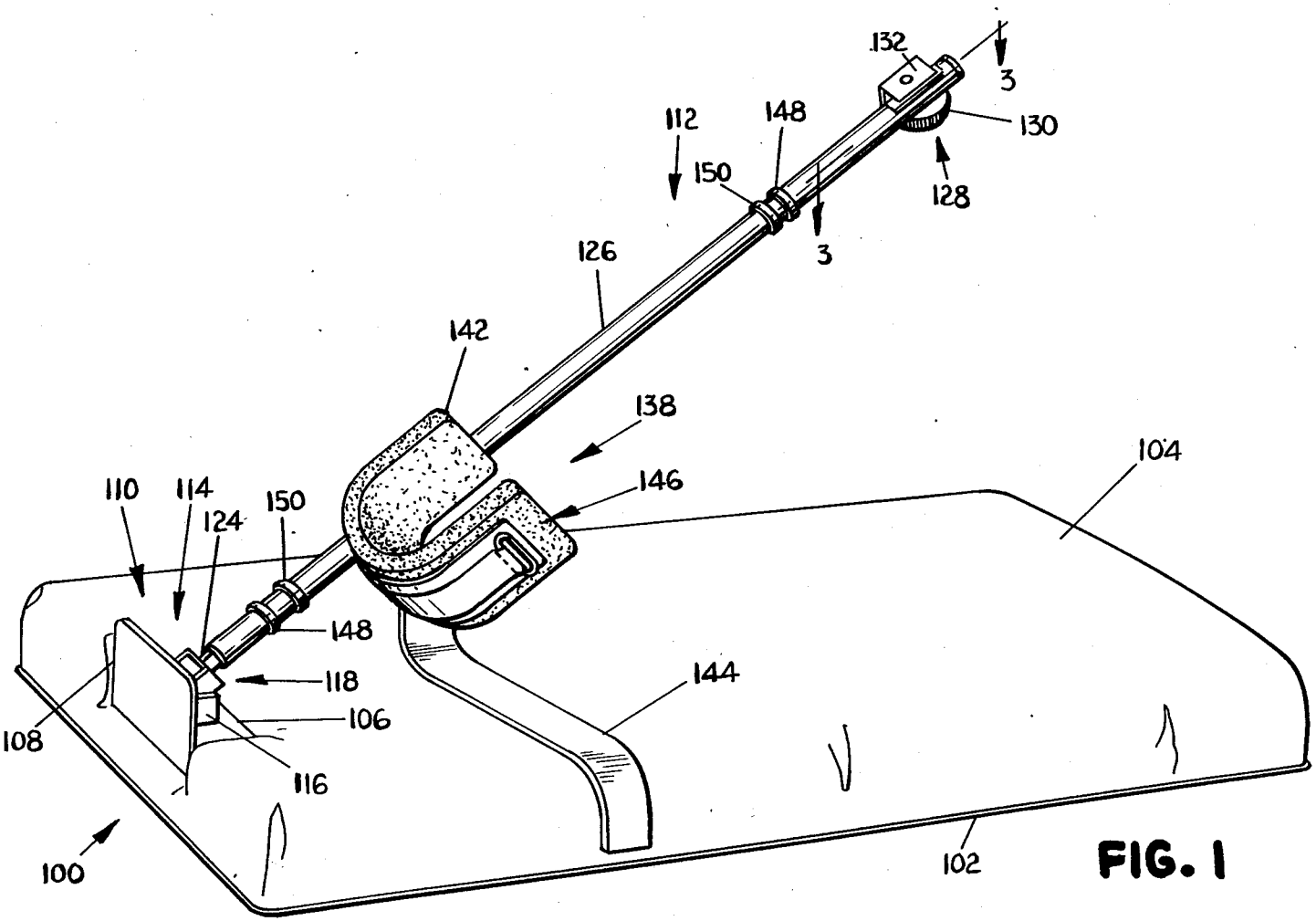
FIG. 1 is a perspective view of a hip joint exercising apparatus in accordance with the invention.
Figure 2:
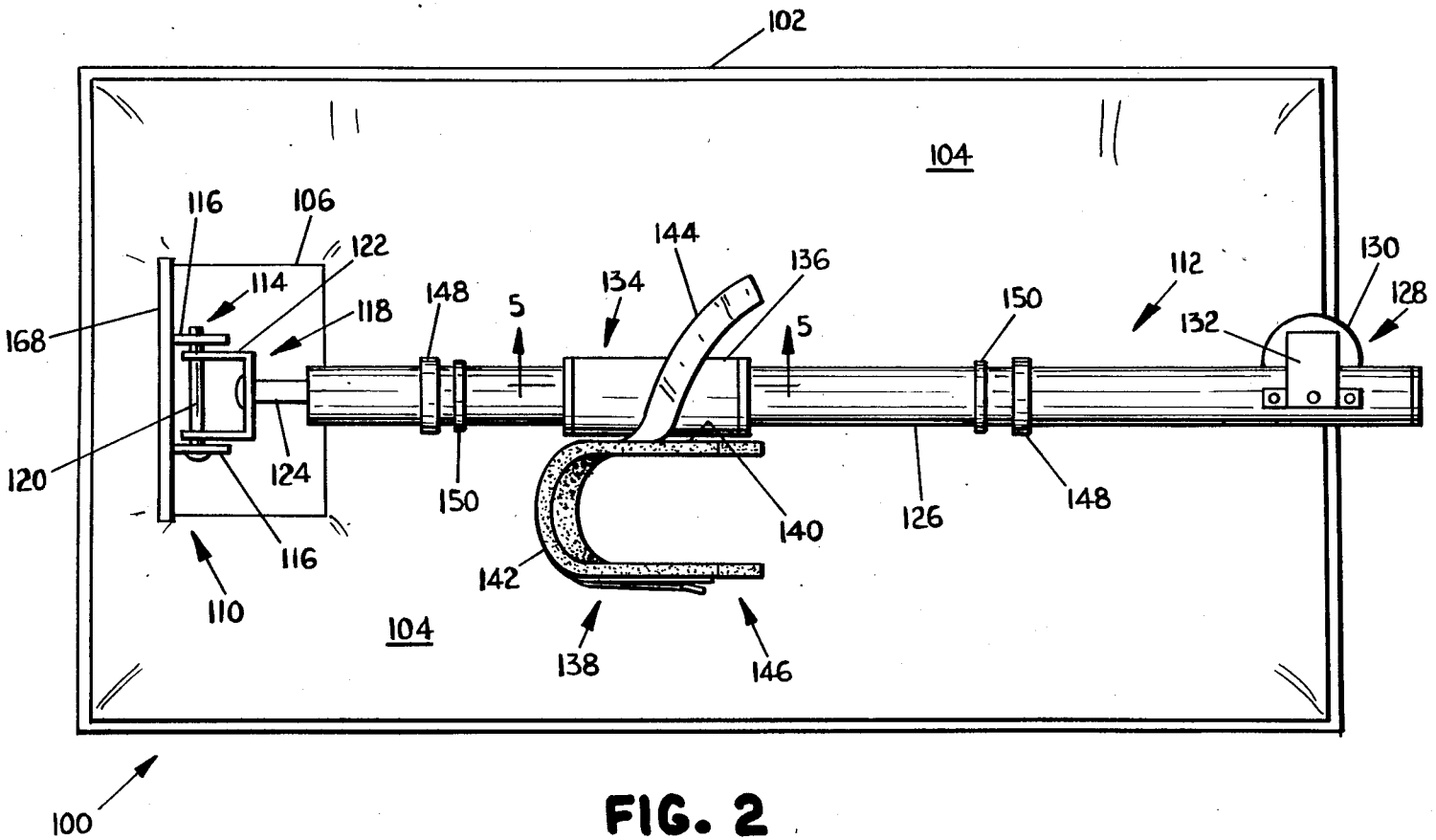
FIG. 2 is a plan view of the hip joint exercising apparatus shown in FIG. 1.

Referring to FIGS. 1 and 2, the hip joint exercise apparatus 100 includes a rectangular base 102 having an area sufficient to support the patient's body during exercise. Mounted to the rectangular base 102 in any suitable and conventional manner is a cushion 104 to provide comfort to the patient during the exercises.

Embedded within the cushion 104 and secured to the rectangular base 102 is a horizontal plate 106 attached on one side to a vertical support plate 108. The plates 106 and 108 form an end support bracket 110 utilized to pivotably secure an exercise bar assembly 112. The bar assembly 112 is connected to the end support bracket 110 by means of a pivot connection 114 comprising a pair of flanges 116 extending inwardly from the vertical support plate 108. The flanges 116 are connected to an end handle 118 comprising a pivot axle 120 extending through appertures (not shown) of the flanges 116 so as to provide an adjustably pivotable connection to adjust the angle of exercise bar assembly 112 relative to the plane of cushion 104. The end handle 118 comprises a handle bracket 122 mounted to the pivot axle 120 and a handle rod 124 rigidly secured by any suitable means to the handle bracket 122.

The exercise bar assembly 112 provides a means for exerting resistive forces opposing the forces exerted by the user patient during exercise. Again referring to FIGS. 1 and 2, the exercise bar assembly 112 includes an elongated outer tube 126, with the handle rod 124 received within one end thereof. The bar assembly 112 also includes a force measuring mechanism 128 comprising a gauge housing 130 and gauge mounting bracket 132 secured to the distal end of the outer tube 126. The force measuring mechanism 128 provides a means for visually indicating to the user patient the amount of force being exerted during exercises as subsequently described herein.

As shown in FIG. 2, mounted to the elongated outer tube 126 is a power slide 134 comprising a slideable sleeve 136 friction mounted on the elongated tube 126. a leg saddle assembly 138 is releasably connected to the sleeve 136 by means of a connector stem 140. The saddle assembly 138 comprises a U-shaped saddle 142 having an inner volume of sufficent size to receive the patient's leg. Mounted to the outer surface of the U-shaped saddle 142 is a flexible strap 144 which can be releasably secured to a buckle 146 so as to secure the patient's leg during exercise.

The elongated outer tube 126 is preferably constructed of a light weight but durable material. Mounted to the outer tube 126 on each side of the power slide sleeve 136 are a pair of adjustable control rings 148 conventional in design and selectively positionable by the user patient along the axial length of outer tube 126. A pair of lubrication rings 150 are mounted on the outer tube 126 inwardly of the control rings 148. The lubrication rings 150 can be made of leather or similar material, and impregnated with a lubricant.

The magnitude of resistance required to move the power slide 134 with respect to the outer tube 126 can be decreased by providing lubrication on the tube 126 by sliding the lubrication rings 150 along the radial surface of tube 126. Similarly, resistance can be increased by removing lubrication from the outer surface of tube 126, and variable resistance can be provided over a particular range of motion by selectively lubricating or removing lubrication from various portions of tube 126. The adjustable control rings 148 provide a means for limiting the range of motion of power slide 134 relative to outer tube 126. In addition, moving the control rings 148 inward so that the motion of power slide 134 is blocked will allow isometric exercise and isometric testing of muscle strength of the user.

As previously referenced, the power slide 134 is mounted to the elongated outer tube 126 in a friction mounting arrangement. That is, the sleeve 136 is slideable along the outer tube 126, but with some degree of force required to generate the sliding movement. The friction mounting can also provide, if desired, a substantially higher frictional resistance to movement of the sleeve 136 in one direction along the axial length of tube 126 than in the opposing direction of relative movement. Ordinarily, a friction mounting arrangement works in an isotropic manner. In addition, the friction mounting can provide for a frictional resistance directly proportional to the linear forces exerted by the user and applied to the sleeve 136 relative to the outer tube 126.

Figure 5:
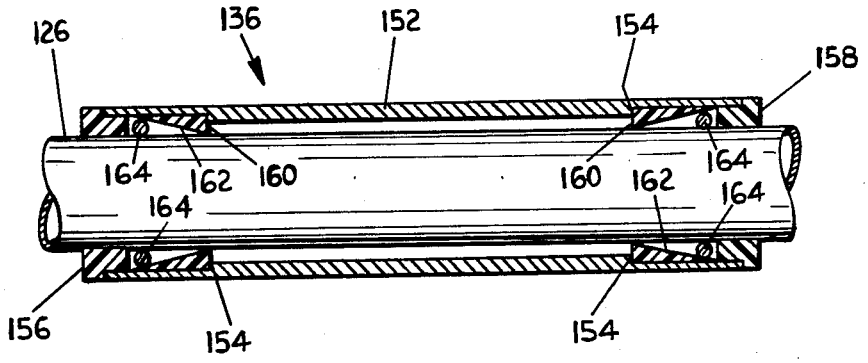
FIG. 5 is a sectional view of the exercise bar assembly of the hip joint exercising apparatus showing an exemplary friction mounting of the power slide to the elongated tube and taken along lines 5—5 of FIG. 2.

An exemplary friction mounting arrangement comprising several of these features and suitable for use in the hip joint exercising apparatus 100 is depicted in FIG. 5. Referring thereto, the sleeve 136 comprises a tubular member 152 which is concentric with the axis of the outer tube 126. The inner diameter of the tubular member 152 is larger than the outer diameter of the tube 126 so that an annular space is provided therebetween. Annular shoulders 154 are found in the inner surface of the tubular member 152. The tubular member 152 is supported on the elongated tube 126 by a pair of annular frictionless bushings 156 and 158. The bushings 156 and 158 are maintained on the tubular member 152 through any suitable connecting means, such as a pair of set screws, staking or adhesive interconnections.

A pair of brake mechanisms 160 are mounted within the tubular member 152, adjacent to the frictionless bushings 156 and 158, and in abutting relationship with the corresponding annular shoulders 154. The brake mechanisms 160 each comprise an elongated annular bushing, preferably made of plastic and having an internal ramped or conical surface 162. A pair of rubber "O"-rings 164 are slidably mounted on the elongated outer tube 126, each fitting within an end of a corresponding brake mechanism 160. The inner diameter of each O-ring 164 is only slightly smaller than the outer diameter of the outer tube 126 so that there is some frictional resistance between each O-ring 164 and the outer tube 126. Any suitable rubber or synthetic O-ring can be used.

In operation, the user exerts forces on the power slide 134 and moves the sleeve 136, for example, to the right as viewed in FIG. 5. As the sleeve 136 is moved to the right, the frictional resistance between the O-ring 164 on the right and the elongated outer tube 126 causes the right-side O-ring 164 to ride up on the corresponding and adjacent ramp 162, thereby increasing the frictional resistance between the right-side O-ring 164 and the outer tube 126. The extent of movement of the right-side O-ring 164 and the extent of frictional forces between the O-ring 164 and the outer tube 126 depend on the forces applied by the user to the sleeve 136. In other words, the harder the force, the greater the frictional resistance of the sleeve 136. Thus, the power slide 134 provides a varying kinematic resistance to movement along the outer tube 126, the amount of frictional resistance being dependent on the amount of force applied to the power slide 134 with respect to the outer tube 126.

During movement of sleeve 136 to the right as viewed in FIG. 5, the left-side O-ring 164 will move into abutting relationship with the corresponding bushing 156. In this position of the left-side O-ring 164 with respect to the surface 162 of corresponding brake mechanism 160, little or no frictional resistance is applied by the left-side O-ring 164 on the elongated tube 126. However, movement of the sleeve 136 to the left as viewed in FIG. 5 will cause the left-side O-ring 164 to ride up on the ramp surface 162 of the corresponding left-side brake mechanism 160. In the same manner as previously described for movement of sleeve 136 to the right, the amount of frictional resistance between sleeve 136 and tube 126 will be dependent on the amount of force applied to power slide 134 with respect to the outer tube 126.

It should be emphasized that various other types of friction mounting arrangements can be employed with the hip joint exercising apparatus 100. The aforedescribed particular means for mounting the power slide 134 to the elongated outer tube 126 does not form the basis for the principal concepts of the invention described and claimed herein.

Figure 3:
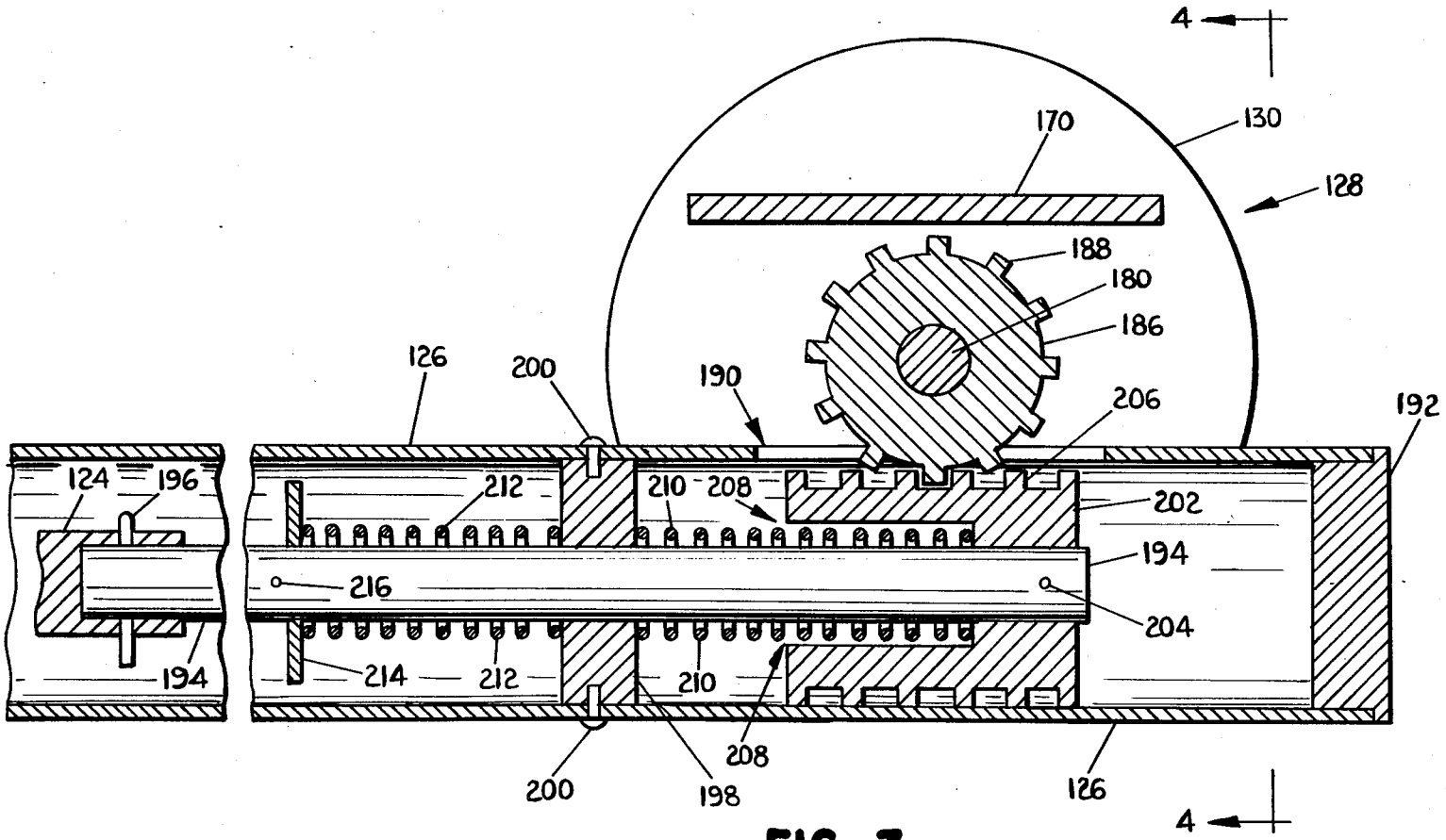
FIG. 3 is a sectional view of the force measuring mechanism of the hip joint exercising apparatus taken along lines 3—3 of FIG. 1.
Figure 4:
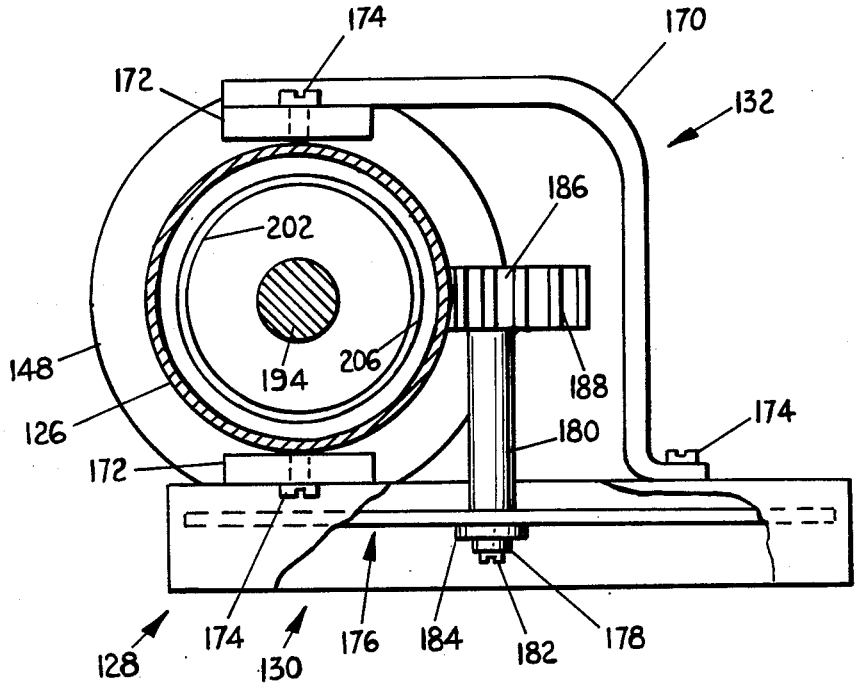
FIG. 4 is a sectional end view of the force measuring mechanism taken along lines 4—4 of FIG. 3.

As previously referenced, a force measuring mechanism 128 is mounted to the distal end of the elongated outer tube 126. Referring to FIGS. 3 and 4, the force measuring mechanism 128 includes a circular gauge housing 130 rigidly mounted to the outer tube 126 by means of the mounting bracket 132. As shown in FIG. 4, the mounting bracket 132 includes an angled bracket 170 secured to the bottom of gauge housing 130 and to the top portion of tube 126 through one of two straight brackets 172 and screws 174. At the lower portion of the outer tube 126 as depicted in FIG. 4, the housing 130 is mounted to the outer tube 126 by means of screws 174 connected through a second straight bracket 172.

Mounted within the housing 130 and maintained stationary relative thereto is a dial face 176 having spaced apart marks to provide a visual indication of the forces exerted by the patient during use of the hip joint exercising apparatus 100. Rotatably mounted immediately in front of the dial face 176 is a dial pointer 178. The dial pointer 178 is secured to a gear shaft 180 by means of a screw 182 and stationary washer plate 184. The mounting of the dial pointer 178 in front of the dial face 176, and the mounting of gear shaft 180 through dial gauge housing 130 and dial face 176, allows the shaft 180 to rotate relative to the dial face 176, thereby correspondingly rotating dial pointer 178 to indicate magnitudes of externally exerted forces as described herein.

Referring specifically to FIG. 4, gear shaft 180 extends upwardly alongside the outer tube 126. As shown in FIGS. 3 and 4, rigidly mounted to shaft 180 at its upper end is a pinion gear 186 having a series of gear teeth 188. The pinion gear teeth 188 extend into a slot 190 located in the radial surface of outer tube 126.

Referring particularly to FIG. 3, the handle rod 124 extends inwardly from the end of the outer tube 126 adjacent the end handle 118. Although not shown in FIG. 3, a stop and guide block is inserted into the corresponding end of outer tube 126 and is similar to the stop and guide block 192 shown inserted into the distal end of the outer tube 126, except that unlike block 192, a central aperture is included in the block to allow insertion of handle rod 124. The end of the handle rod 124 extending into outer tube 126 includes a recessed area conforming to the shape of a slide rod 194. One end of the slide rod 194 is rigidly secured to the handle rod 124 by means of a cotter pin 196.

As also shown in FIG. 3, the slide rod 194 extends through the axial length of outer tube 126, is centrally positioned therein, and supported by means of a stationary guide block 198 rigidly secured to the outer tube 126 through screws 200. Located within the outer tube 126 and intermediate the guide block 198 and the distal end of slide rod 194 is a spring cup 202 as also depicted in FIG. 3. The spring cup 202 includes a cylindrical apperture in which the slide rod 194 is axially received. Slide rod 194 is secured in a stationary position relative to spring cup 202 by means of a pin 204 or similar connecting means.

The spring cup 202 can be substantially cylindrical in shape and includes peripheral rack teeth 206. The rack teeth 206 are positioned within outer tube 126 adjacent the slot 190, and the pinion gear teeth 188 are positioned so as to engage the rack teeth 206.

As also depicted in FIG. 3, the spring cup 202 includes a centrally located slot 208 open at one end and extending partially through the axial length of the spring cup 202. Mounted within the slot 208 and extending outwardly around the slide rod 194 to the guide block 198 is a compression spring 210. Located on the opposing surface of guide block 198 from the compression spring 210 is a second compression spring 212. Compression spring 212 is also positioned around the radial surface of slide rod 194 and supported at opposing ends by the guide block 198 and a washer 214 fixed in a stationary position relative to the slide rod 194 by means of a roll pin 216 or a similar securing means.

During use of the hip joint exercising apparatus 100, the handle rod 124 and slide rod 194 remain stationary except for pivotable movement relative to the plane of cushion 104. When the power slide 134 is moved along the elongated tube 126 away from the handle rod 124, the elongated tube 126 will move to the right as viewed in FIG. 3. With handle rod 124, slide rod 194 and spring cup 202 remaining stationary, movement of the elongated tube 126 will cause the pinion gear 186 to rotate clockwise as depicted in FIG. 3. Accordingly, a visual indication of exerted force will be provided to the patient. Correspondingly, with the elongated tube 126 moving to the right, the compression spring 210 will be increasingly compressed as the axial distance between guide block 198 and spring cup 202 is decreased. Similarly, movement of the elongated tube 126 to the left as viewed in FIG. 3 will cause the second compression spring 212 to be increasingly compressed as the guide block 198 moves toward the washer 214 mounted on slide rod 194.

The resistance of the movement of the outer tube 126 with respect to the slide rod 194 will be proportional to the frictional force of the power slide 134 on the outer tube 126. With the force measuring mechanism 128 arranged as described above, movement of the dial pointer 178 will therefore be proportional to the frictional force between the power slide sleeve 136 and the outer tube 126.

Figure 6:
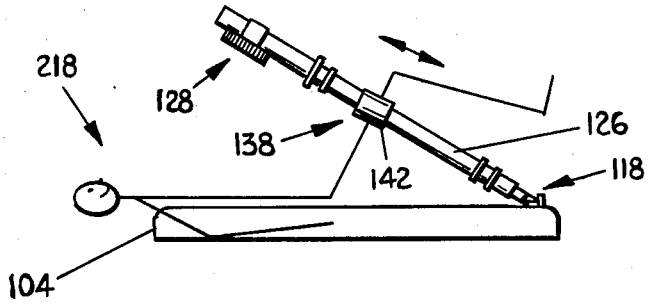
FIG. 6 depicts use of the hip joint exercising apparatus shown in FIG. 1 for hip flexion and extension.

Exemplary exercises for the muscle/skeletal groups around the hips and employing the hip joint exercise unit 100 will now be described with respect to FIGS. 6, 7 and 8. One exercise to provide hip flexion and extension is shown in FIG. 6. The patient 218 maintains a prone position on his or her back on the cushion 104. One of the patient's legs is secured within the saddle assembly 138 so that the saddle 142 is secured around the patient's thigh immediately above the knee. With the knee bent, the patient 218 moves his knee toward and away from his chest, thereby moving the power slide 134 relative to the end handle 118.

Figure 7:
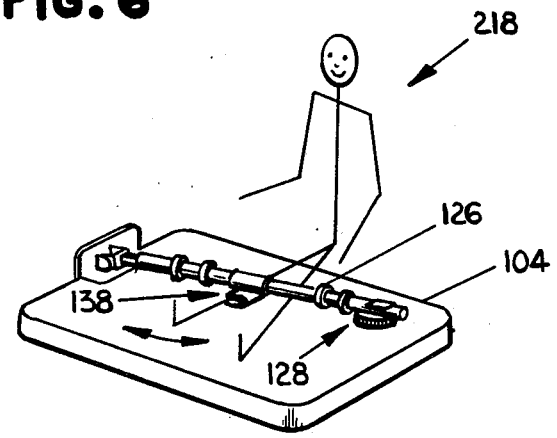
FIG. 7 depicts use of the hip joint exercising apparatus shown in FIG. 1 for hip abduction and adduction.

To provide an exercise involving hip abduction and adduction, the patient 218 maintains a sitting position with his legs positioned transversely across the cushion 104 as depicted in FIG. 7. One of the patient's leg is strapped into the saddle 142 of saddle assembly 138 at the knee joint, and the leg is moved laterally in a sideways motion. Preferably, to provide complete hip abduction and adduction, while precluding any over-extension or straining of the muscle groups, the leg should be moved through a range of motion comprising an arc of approximately 30°.

Figure 8:
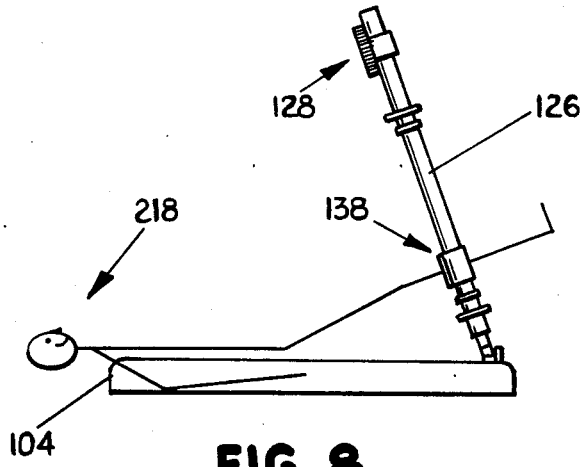
FIG. 8 depicts use of the hip joint exercising apparatus shown in FIG. 1 for exercises whereby the patient's leg is raised while fully extended.

One common type of exercise, conventionally designated as the "straight leg raise", can employ the hip joint exercising apparatus 100 as shown in FIG. 8 to provide an opposing resistance to movement of the leg. As shown in FIG. 8, the patient 218 maintains a prone position on his back comfortably resting on the cushion 104. The saddle assembly 138 is positioned so that one of the patient's leg is secured to saddle 142 in the calf region with the leg fully extended. While maintaining the leg in a fully extended position, the patient 218 alternately raises and lowers his leg. One particular advantage to use of the hip joint exercising apparatus 100 for leg raise exercises is the existence of resistive forces to movement, even during downward motion of the leg.

Although FIGS. 6, 7 and 8 depict three exemplary exercises employing the hip joint exercising apparatus 100, it is apparent that numerous other exercises employing apparatus 100 can also be performed. For example, exercises involving lateral and medial rotation can be provided by having the patient maintain a sitting position on a table, with his legs extending downwardly below the table surface. The hip joint exercising apparatus 100 can be positioned so that one of the patient's legs is secured in saddle assembly 138 at the ankle region. With the patient's knee preferably stabilized in some manner to prevent abduction and flexion of the hip, the patient can laterally rotate the hip by laterally moving the foot associated with the secured leg.

Figure 9:
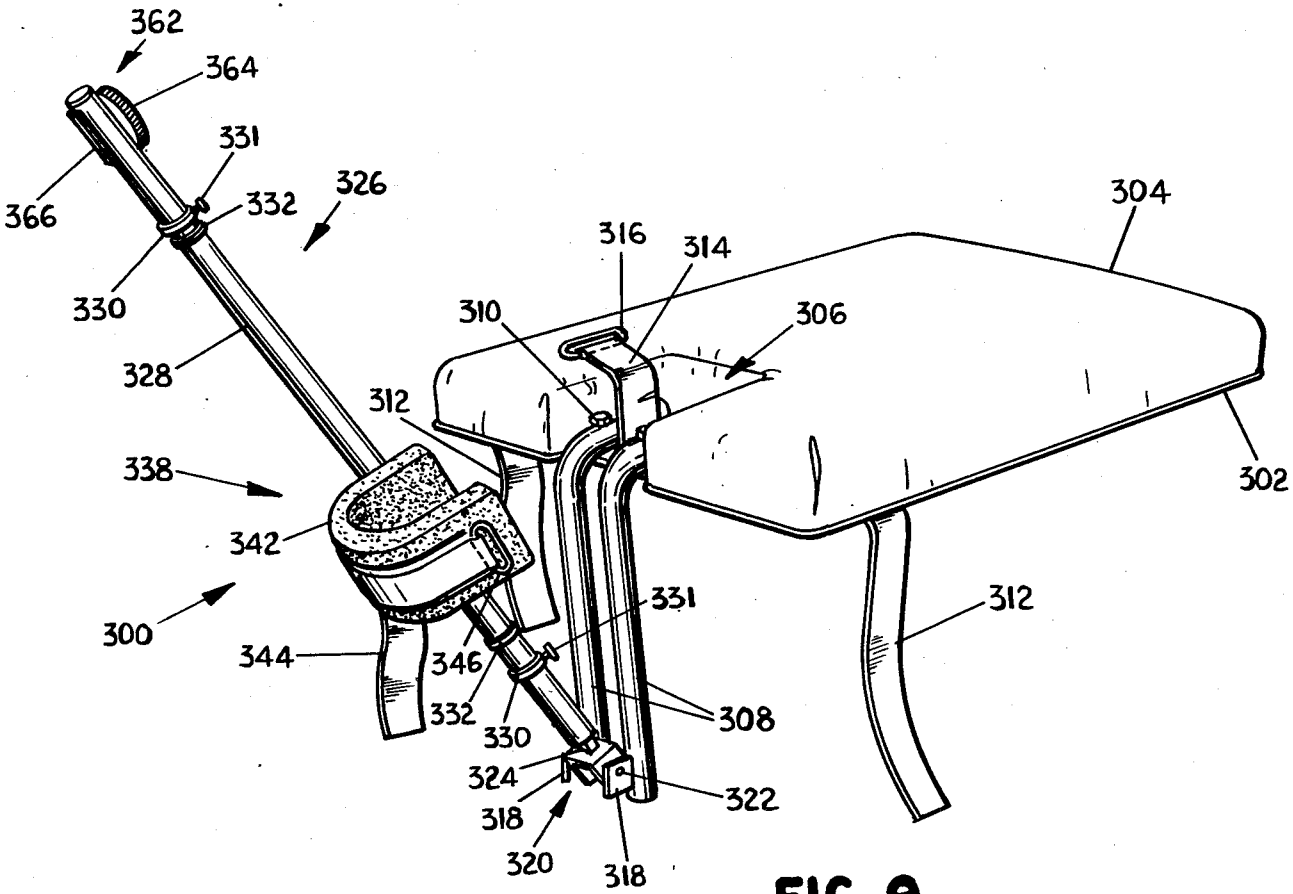
FIG. 9 is a perspective view of a knee joint exercising apparatus in accordance with the invention.
Figure 10:
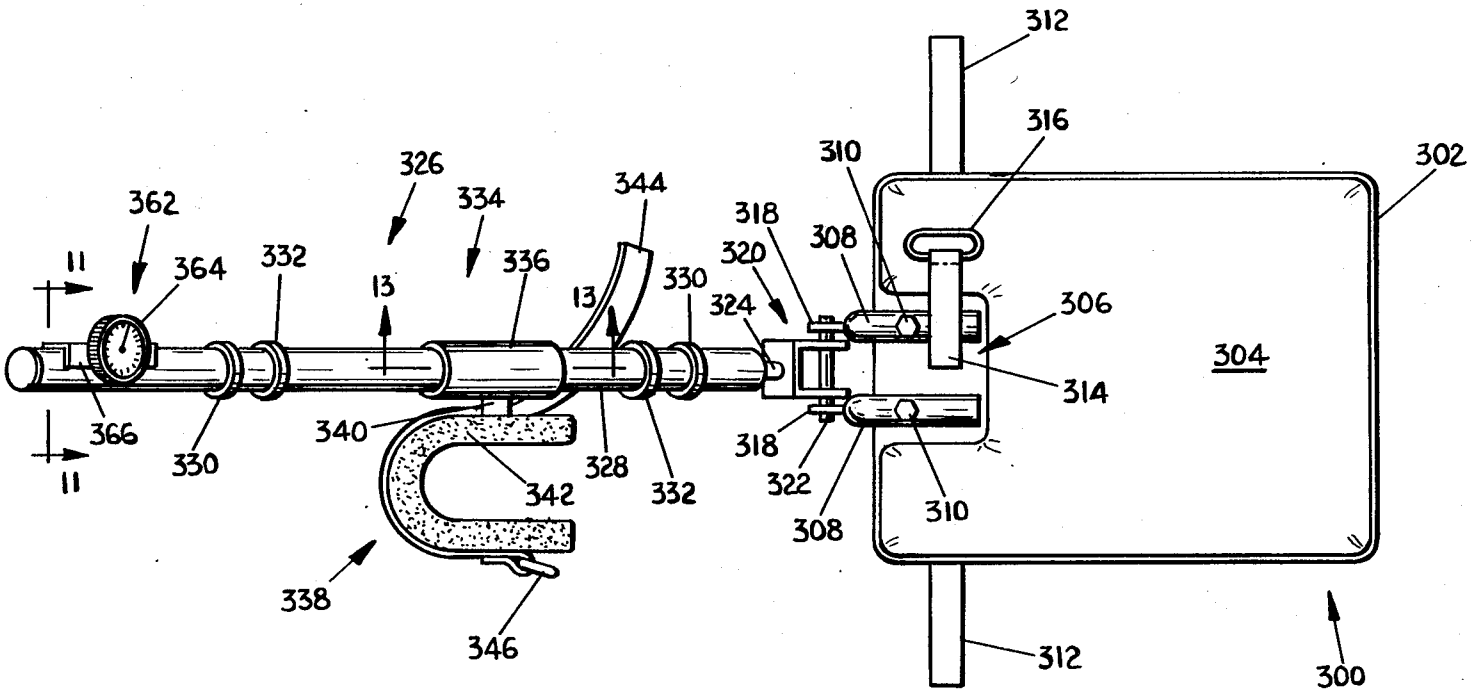
FIG. 10 is a plan view of the knee joint exercising apparatus shown in FIG. 9.

The principles of the invention are also shown in the knee joint exercising apparatus 300 as depicted in FIGS. 9–13. Referring to FIGS. 9 and 10, the knee joint exercising apparatus 300 includes a rectangular base 302 having an area sufficient to support the patient's body in a sitting position during the exercise. Mounted to the rectangular base 302 in any suitable and conventional manner is a cushion 304 to provide comfort to the patient during exercise.

The cushion 304 includes a recessed area 306 at one end thereof. Within the recessed area 306, a pair of downwardly curved tubular bars 308 extend outwardly and downwardly from the cushion 304 as depicted in FIG. 9. The tubular bars 308 are mounted to the rectangular base 302 by any suitable connecting means, such as the nut and bolt assemblies 310.

To secure the patient's legs on the cushion 304, the knee joint exercising apparatus 300 includes a pair of leg straps 312 mounted to the lower portion of the rectangular base 302 at opposing sides thereof. A common strap 314 is secured by any suitable connecting means to the rectangular base 302 within the recessed area 306, and includes a buckle 316 for purposes of selectively strapping and securing either of the patient's legs by means of the leg straps 312.

At the lower terminating ends of the pair of curved bars 308 are a pair of forwardly extending flanges 318. A pivot connection 320 is formed by a pivot axle 322 secured between the flanges 318 and connected in a clevis type connection to an end handle comprising a handle rod 324 coupled to an exercise bar mechanism 326 as shown in FIG. 9. The pivot connection 320 allows an elongated exercise bar mechanism 326 to be adjustably angled relative to the curved bars 308 and the cushion 304.

The exercise bar mechanism 326 includes an elongated outer tube 328 preferably constructed of a lightweight but durable material. Mounted to the outer tube 328 are a pair of adjustable control rings 330 selectively positionable by the user patient along the axial length of the outer tube 328. Each ring 330 is slidable along the length of the tube 328 and has a set screw 331 threaded therein to secure the ring 330 in a selectively adjusted position. A pair of lubrication rings 332 are mounted on outer tube 328 inwardly of the control rings 330. The lubrication rings 332 can be made of leather or similar material, and impregnated with a lubricant.

As shown in FIG. 10, positioned between the adjustable control rings 330 is a power slide 334 comprising a slidable sleeve 336 friction mounted on the elongated outer tube 328. A leg saddle assembly 338 is releasably connected to the sleeve 336 by means of a connector stem 340. The saddle assembly 338 comprises a U-shaped saddle 342 having an inner volume of sufficient size to releasably secure the patient's leg during exercises as subsequently described herein. Mounted to the outer surface of the U-shaped saddle 342 is a flexible strap 344 which can be secured to a buckle 346 so as to strap the patient's leg within the saddle 342 during exercise.

The power slide 334 is mounted to the elongated outer tube 328 in a friction mounting arrangement. That is, the power slide sleeve 336 is slidable along the outer tube 328, but with some degree of force required to generate the sliding movement. The friction mounting can provide a substantially higher frictional resistance to movement of the sleeve 336 in one direction along the actual length of tube 328 than in the opposing direction of relative movement. Ordinarily, the mounting arrangement is isotropic. In addition, the friction mounting can provide for a frictional resistance directly proportional to the linear forces exerted by the user and applied to the sleeve 336 relative to the outer tube 328.

Figure 13:
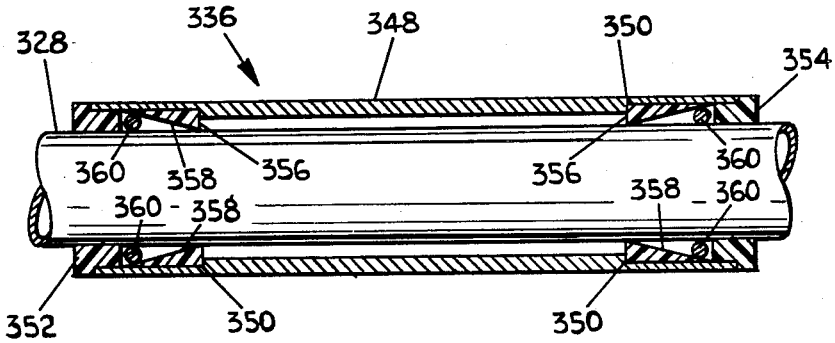
FIG. 13 is a sectional view of the exercise bar mechanism of the knee joint exercising apparatus showing an exemplary friction mounting of the power slide to the elongated tube and taken along lines 13—13 of FIG. 10.

An exemplary friction mounting arrangement comprising several of these features and suitable for use in the knee joint exercising apparatus 300 is depicted in FIG. 13. Referring thereto, the sleeve 336 comprises a tubular member 348 which is concentric with the axis of the outer tube 328. The inner diameter of the tubular member 348 is larger than the outer diameter of the tube 328 so that an annular space is provided therebetween. Annular shoulders 350 are found in the inner surface of the tubular member 348. The tubular member 348 is supported on the elongated tube 328 by a pair of annular frictionless bushings 352 and 354. The bushings 352 and 354 are maintained on the tubular member 348 through any suitable connecting means, such as a pair of set screws, staking, or adhesive interconnections.

A pair of brake mechanisms 356 are mounted within the tubular member 348, adjacent to the frictionless bushings 352 and 354, and in abutting relationships with annular shoulders 350. The brake mechanisms 356 each comprise an elongated annular bushing, preferably made of plastic and having an internal ramp or conical surface 358. A pair of annular O-rings 360 are slidably mounted on the elongated outer tube 328, each fitting within a corresponding annular brake mechanism 356. The inner diameter of each O-ring 360 is only slightly smaller than the outer diameter of the elongated tube 328 so that there is some frictional resistance between each O-ring 360 and the tube 328. Any suitable rubber or synthetic rubbery material can be used.

In operation, the user exerts forces on the power slide 334 and moves the sleeve 336, for example, to the right as viewed in FIG. 13. As the sleeve 336 is moveds to the right as viewed in FIG. 13, the frictional resistance between the O-ring 360 on the right and the elongated outer tube 328 causes the right-side O-ring 360 to ride up on the corresponding and adjacent ramp surface 358, thereby increasing the frictional resistance between the O-ring 360 and the tube 328. The extent of movement of the O-ring 360 and the outer tube 328 depend on the forces applied by the user patient to the sleeve 336. In other words, the harder the force, the greater the frictional resistance of the sleeve 336. Thus, the power slide 334 provides a varying kinematic resistance to movement along the outer tube 328, the amount of frictional resistance being dependent on the amount of force applied to the power slide 334 with respect to the outer tube 328.

During movement of sleeve 336 to the right as viewed in FIG. 13, the left-side O-ring 360 will move into abutting relationship with the corresponding bushing 352. In this position of the left-side O-ring 360 with respect to the ramp surface 358 of corresponding brake mechanism 356, little or no frictional resistance is applied by the left-side O-ring 360 on the elongated outer tube 328. However, movement of the sleeve 336 to the left as viewed in FIG. 13 will cause the left-side O-ring 360 to ride up on ramp surface 358 of the corresponding left-side brake mechanism 356. In the same manner as previously described for movement of sleeve 336 to the right, the amount of frictional resistance between sleeve 336 and elongated tube 328 will be dependent upon the amount of force applied to power slide 334.

It should be noted that the magnitude of resistance required to move the power slide 334 with respect to the outer tube 328 can be decreased by providing lubrication on the tube 328 through the lubrication rings 332 previously described with respect to FIGS. 9 and 10. In this manner, the frictional resistance between sleeve 336 and tube 328 can be decreased. Similarly, resistance can be increased by removing lubrication from the outer surface of tube 328, and variable resistance can be provided over a particular range of motion by selectively lubricating or removing lubrication from various portions of tube 328. In addition, it should also be noted that the adjustable control rings 330 provide a means for limiting the range of motion of sleeve 336 relative to outer tube 328. In addition, moving the control rings 330 inwardly so that motion of power slide 334 is blocked will allow isometric exercise and also isometric testing of muscle strength of the user patient.

It should also be emphasized that various other types of friction mounting arrangements can be employed with the knee joint exercising apparatus 300. The aforedescribed particular means for mounting the power slide 334 to the elongated outer tube 328 does not form the basis for the principal concepts of the invention described and claimed herein.

Figure 11:
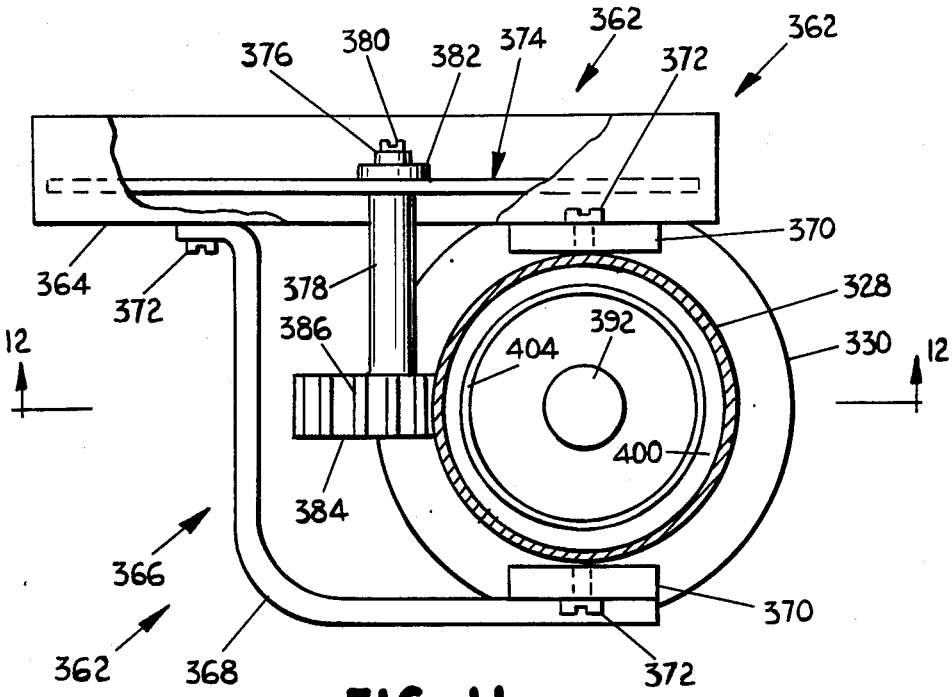
FIG. 11 is a sectional end view of the force measuring mechanism of the knee joint exercising apparatus taken along lines 11—11 of FIG. 10.

Referring again to FIGS. 9 and 10, the exercising apparatus 300 also includes a force measuring mechanism 362 mounted to the distal end of the elongated outer tube 328 of exercise bar mechanism 326. The force measuring mechanism 362 includes a circular gauge housing 364 rigidly mounted to the outer tube 328 by means of the mounting bracket 366. Referring to FIG. 11, the mounting bracket 366 includes an angled bracket 368 secured to the bottom of gauge housing 364 and to one of two straight brackets 370 through screws 372. At the upper portion of the outer tube 328 as depicted in FIG. 11, the gauge housing 364 is directly mounted to the outer tube 328 by means of screws 372 connected through a second straight bracket 370.

Mounted within the housing 364 and maintained stationary relative thereto is a dial face 374 having spaced-apart markings to provide a visual indication of the forces exerted by the user patient during use of the knee joint exercising apparatus 300. Rotatably mounted immediately above the dial face 374 is a dial pointer 376. The dial pointer 376 is secured to a gear shaft 378 by means of a screw 380 and stationary washer plate 382. The mounting of the dial pointer 376 above the dial face 374, and the mounting of gear shaft 378 through dial gauge housing 364 and dial face 374, allows the shaft 378 to rotate relative to the dial face 374, thereby correspondingly rotating dial pointer 376 to indicate magnitudes of externally exerted forces as described herein.

Figure 12:
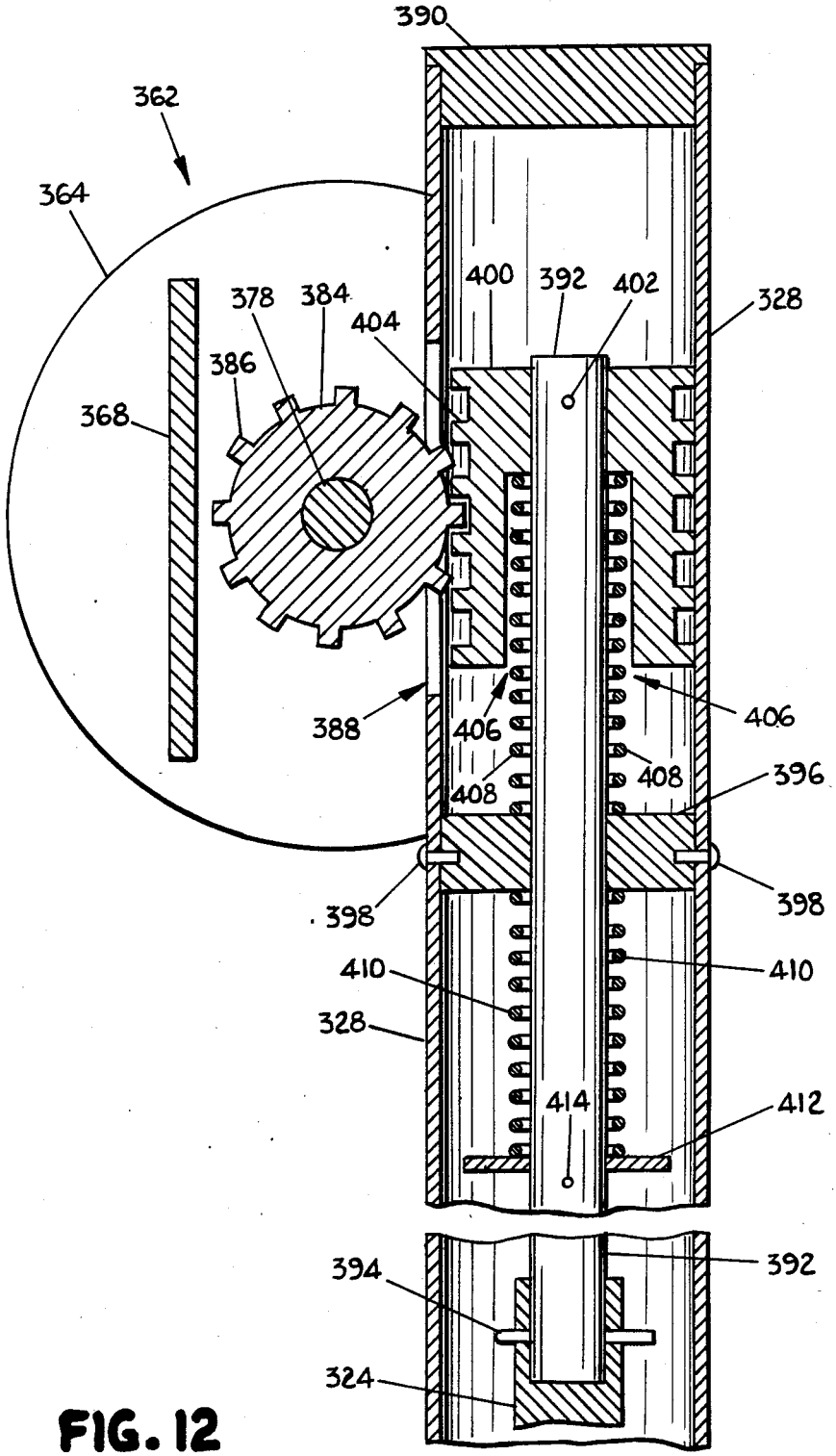
FIG. 12 is a sectional view of the force measuring mechanism taken along lines 12—12 of FIG. 11.

As also shown in FIG. 11, gear shaft 378 extends downwardly relative to the position of outer tube 328 as depicted in FIG. 11. Rigidly mounted to the shaft 378 at its lower end is a pinion gear 384 having a series of gear teeth 386. As shown in FIG. 12, the pinion gear teeth 386 extend into a slot 388 located in the radial surface of outer tube 328.

Referring particularly to FIG. 12, the handle rod 324 extends inwardly from the end of outer tube 328 adjacent the pivot connection 320, and into the outer tube 328. Although not shown in FIG. 12, a stop and guide block would be inserted into the corresponding end of outer tube 328 and would be similar to the stop and guide block 390 shown inserted into the distal end of the outer tube 328, except that the block would include an aperture through which the handle rod 324 could be inserted. The end of the handle rod 324 extending into outer tube 328 includes a recessed area conforming to the shape of a slide rod 392. One end of the slide rod 392 is rigidly secured to the handle rod 324 by means of a cotter pin 394.

The slide rod 392 extends through the axial length of outer tube 328, and is centrally positioned therein and supported by means of a stationary guide block 396 rigidly secured to the outer tube 328 through screws 398. Located within the outer tube and intermediate the guide block 396 and the distal end of the slide rod 392 is a spring cup 400 as also depicted in FIG. 12. The spring cup 400 includes a cylindrical aperture in which the slide rod 392 is axially received. Slide rod 392 is secured in a stationary position relative to spring cup 400 by means of a pin 402 or similar connecting means.

The spring cup 400 can be substantially cylindrical in shape and include peripheral rack teeth 404. The rack teeth 404 are positioned within outer tube 428 adjacent the slot 388, and the pinion gear teeth 386 are positioned so as to engage the rack teeth 404.

As also depicted in FIG. 12, the spring cup 400 includes a centrally located slot 406 open at one end and extending partially through the axial length of the spring cup 400. Mounted within the slot 406 and extending outwardly around the slide rod 392 to the guide block 396 is a first compression spring 408. Bearing against the opposing surface of guide block 396 from the first compression spring 408 is a second compression spring 410. Compression spring 410 is also positioned around the radial surface of slide rod 392 and supported at opposing ends by the guide block 396 and a washer 412 fixed in a stationary position relative to the slide rod 392 by means of a roll pin 414 or a similar securing means.

During operation of the knee joint exercising apparatus 300, the slide rod 392 remains stationary except for pivotable movement relative to the plane of cushion 304. When the power slide 334 is moved along the elongated tube 328 away from the handle rod 324, the elongated tube 328 will move upwardly as viewed in FIG. 12. With handle rod 324, slide rod 392 and spring cup 400 remaining stationary, movement of the elongated tube 328 will cause the pinion gear 384 to rotate clockwise as depicted in FIG. 12. Accordingly, a visual indication of exerted forces will be provided to the user patient. Correspondingly, with the elongated tube 328 moving upwardly as viewed in FIG. 12, the compression spring 408 will be increasingly compressed as the axial distance between guide block 396 and spring cup 400 is decreased. Similarly, movement of the elongated tube 328 downwardly as viewed in FIG. 12 will cause the second compression spring 410 to be increasingly compressed as the guide block 396 moves towards the washer 12 mounted on slide rod 392.

The axial movement of the outer tube 328 with respect to the slide rod 392 will be proportional to the frictional force of the power slide 334 on the outer tube 328. With the force measuring mechanism 362 configured as described above, movement of the dial pointer 376 will therefore be proportional to the frictional force between the power slide sleeve 336 and the outer tube 328.

Figure 14:
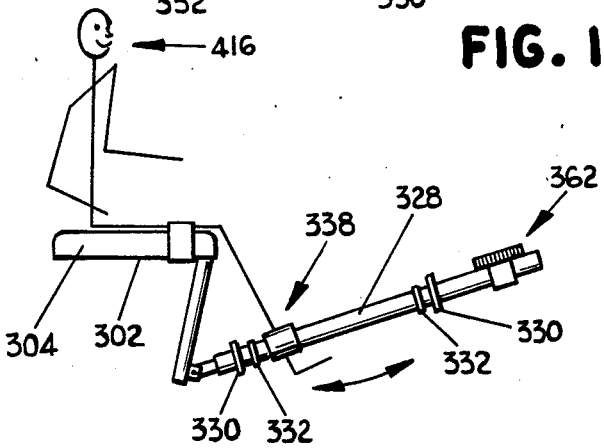
FIG. 14 depicts use of the knee joint exercising apparatus shown in FIG. 9 for knee flexion and extension while the patient is in a sitting position.

An exemplary exercise employing the knee joint exercising apparatus 300 is depicted in FIG. 14. As shown therein, the patient maintains a sitting position on the cushion 304. The patient's legs are secured within the leg straps 312 and extend downwardly with the knees bent at approximately a 90° angle. The saddle assembly 338 is then utilized to secure one of the patient's legs at the region of the ankle. It should be noted that it is only necessary to stabilize the particular leg being exercised with the leg straps 312. That is, the patient's other leg can remain unstrapped. The patient 216 then moves his leg forward so as to move the power slide 334 and saddle assembly 338 toward the distal end of the outer tube 328 of exercise bar mechanism 326. This particular exercise provides knee flexion and extension. To provide full flexion and extension exercise, it is preferable for the patient 416 to move his or her foot upwardly from the initial position and back through an arc of approximately 130°.

The knee flexion and extension exercise depicted in FIG. 14 is merely one type of exercise that can be performed with the use of knee joint exercising apparatus 300. It is apparent that numerous other exercises particularly adapted for the muscle/skeletal group surrounding the knee region can be provided with the use of apparatus 300.

The principles of the invention are not limited to the specific portable hip joint and knee joint exercising apparatus 100, 300 described herein. For example, the positioning of the force measuring mechanisms can be moved to various locations relative to the ends of the elongated tubes. Further, devices other than the specific force measuring mechanisms as described herein can be employed. It will be apparent to those skilled in the art that modifications and other variations of the above-described illustrative embodiment of the invention may be effected without departing from the spirit and scope of the novel concepts of the invention.

The embodiments of the invention in which an exclusive property or privilege is claimed are defined as follows:

1. A hip joint exercise apparatus comprising:
a portable structural frame providing a fixed base support while the exercise apparatus is in use, and having body-positioning means to position one portion of a user's body;
an elongated tube having first and second ends;
an elongated reactive member at least partially received within said first end of said elongated tube;
means for pivotably mounting said first end of said elongated reactive member to said structural frame;
a slide member slidably mounted to said elongated tube;
means providing frictional resistance to movement of said slide member along said elongated tube;
body-engaging means mounted to said slide member for positioning one of the user's legs and for restraining movement of said leg with respect to said slide member during axial movement of said slide member on said elongated tube;
force measuring means mounted to said elongated tube for visually indicating to the user the relative magnitude of force applied between said slide member and said elongated tube;
said elongated tube is pivotable relative to said structural frame simultaneously with said slide member being slidable along said elongated tube so as to provide hip flexion/extension, hip abduction/adduction and straight leg exercises having resistance forces to both upward and downward leg movement; and
said force measuring means comprises means for coupling said elongated reactive member to said elongated tube so that the displacement of said tube relative to said reactive member is proportional to the relative magnitude of force applied between said slide member and said elongated tube.

2. A hip joint exercise apparatus in accordance with claim 1 wherein:
said body-positioning means is a cushion on which the user may sit or lie in a prone position; and
said body-engaging means comprises a U-shaped saddle mounted to said slide member, and means mounted to said saddle for releasably retaining said leg within said saddle.

3. A hip joint exercise apparatus in accordance with claim 1 wherein said force measuring means is positioned on the second end of said elongated tube.

4. A hip joint exercise apparatus in accordance with claim 1 and further comprising means to adjustably limit the movement of said slide member on said elongated tube.

5. A hip joint exercise apparatus in accordance with claim 4 wherein said movement limiting means comprises a pair of rings, slidably mounted on said elongated tube, one of said rings positioned on each side of said slide member and means on each ring for securing said ring in adjusted position on said elongated tube, whereby said slide member can be limited to movement along the entire length of said tube down to no movement at selected positions along the length of said elongated tube.

6. A hip joint exercise apparatus in accordance with claim 1 and further comprising means received on said elongated tube for prohibiting movement of said slide member for strength testing in any position within the range of motion of a user body member.

7. A hip joint exercise apparatus in accordance with claim 1 and further comprising means received on said tube for prohibiting movement of said slide member for isometric exercise at any position within the range of motion of a user body member.

8. A knee joint exercise apparatus comprising:

a portable structural frame providing a fixed base support while the exercise apparatus is in use, and having body-positioning means to position one portion of a user's body;

an elongated tube having first and second ends;

an elongated reactive member at least partially received within said first end of said elongated tube;

elongated means having a first end connected to said structural frame for offsetting the location of said elongated tube from said structural frame;

means connected to a second end of said elongated means for pivotably mounting said first end of said elongated reactive member to said elongated means;

a slide member slidably mounted to said elongated tube;

means providing frictional resistance to movement of said slide member along said elongated tube;

body-engaging means mounted to said slide member and adapted to receive one of said user's legs below the knee joint so as to restrain movement of said leg with respect to said slide member during axial movement of said slide member on said elongated tube;

force measuring means mounted to said elongated tube for visually indicating to said user the relative magnitude of force applied between said slide member and said elongated tube; and said force measuring means comprises means for coupling said elongated reactive member to said elongated tube so that the displacement of said tube relative to said reactive member is proportional to the relative magnitude of force applied between said slide member and said elongated tube.

9. A knee joint exercise apparatus in accordance with claim 8 wherein:

said body-positioning means is a cushion on which said user may sit; and said body-engaging means comprises a U-shaped saddle mounted to said slide member, and means mounted to said saddle for releasably retaining said leg within said saddle.

10. A knee joint exercise apparatus in accordance with claim 8 wherein said elongated means comprises a pair of tubular bars, each having one end connected to said structural frame and another end located downwardly therefrom and connected to said pivotable mounting means.

11. A knee joint exercise apparatus in accordance with claim 9 wherein said elongated tube is pivotably mounted to said elongated means so that said user, while maintaining a sitting position on said cushion with one of said user's legs extending downwardly at approximately a 90° angle from the knee joint, and with said leg retained in said saddle at an ankle region of said leg, can move said slide member along said elongated tube by rotating his or her foot longitudinally to said tube.

12. A knee joint exercise apparatus in accordance with claim 8 wherein said force measuring means is positioned on said second end of said elongated tube.

13. A knee joint exercise apparatus in accordance with claim 12 wherein said force measuring means has a dial face mounted on said elongated tube and visible to said user, and a pointer is rotatably mounted on said dial face to visually indicate the force applied to said slide member.

14. A knee joint exercise apparatus in accordance with claim 8 and further comprising means to adjustably limit the movement of said slide member on said elongated tube.

15. A knee joint exercise apparatus in accordance with claim 14 wherein said movement limiting means comprises a pair of rings, slidably mounted on said elongated tube, one of said rings positioned on each side of said slide member and means on each ring for securing said ring in adjusted position on said elongated tube, whereby said slide member can be limited to movement along the entire length of said tube down to no movement at selected positions along the length of said elongated tube for isometric strength testing and/or isometric exercise at any position within the range of movement of said slide member on said elongated tube.

16. A knee joint exercise apparatus in accordance with claim 8 and further comprising means received on said elongated tube for prohibiting movement of said slide member for strength testing in any position within the range of motion of a user body member.

17. A knee joint exercise apparatus in accordance with claim 8 and further comprising means received on said tube for prohibiting movement of said slide member for isometric exercise at any position within the range of motion of a user body member.

* * * * *